US011789398B2

(12) United States Patent
Fujioka

(10) Patent No.: US 11,789,398 B2
(45) Date of Patent: Oct. 17, 2023

(54) IMAGE FORMING SYSTEM

(71) Applicant: CANON KABUSHIKI KAISHA, Tokyo (JP)

(72) Inventor: Ryota Fujioka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/901,307

(22) Filed: Sep. 1, 2022

(65) Prior Publication Data

US 2023/0075169 A1 Mar. 9, 2023

(30) Foreign Application Priority Data

Sep. 2, 2021 (JP) ..... JP2021-143045
Jul. 12, 2022 (JP) ..... JP2022-111490

(51) Int. Cl.
*G03G 15/02* (2006.01)
*G03G 15/00* (2006.01)

(52) U.S. Cl.
CPC ..... *G03G 15/6585* (2013.01)

(58) Field of Classification Search
CPC ..... G03G 15/5025; G03G 15/5029; G03G 15/5041; G03G 15/5062; G03G 15/6585
See application file for complete search history.

(56) References Cited

U.S. PATENT DOCUMENTS 9,959,492 B2 5/2018 Saito
2008/0079971 A1* 4/2008 Liu ..... G03G 9/0926 358/1.9
2013/0022753 A1* 1/2013 Qiao ..... G03G 15/6585 427/469

FOREIGN PATENT DOCUMENTS

JP 2016-224111 A 12/2016

* cited by examiner

*Primary Examiner* — Hoang X Ngo
(74) *Attorney, Agent, or Firm* — Venable LLP

(57) ABSTRACT

An image forming system includes an image forming unit for forming an image on a recording medium, a varnish applying unit for applying varnish to the image on the recording medium, and a control unit for controlling the image forming unit to form a first image and a second image and for controlling the varnish applying unit to apply varnish to the first image and the second image such that a first varnish application amount applied to the first image by the varnish applying unit is different from a second varnish application amount applied to the second image by the varnish applying unit.

10 Claims, 10 Drawing Sheets

IMAGE FORMING SYSTEM

FIELD OF THE INVENTION AND RELATED ART

The present invention relates to an image forming system including an image forming apparatus for forming a toner image on a recording medium, and a varnish applying apparatus capable of overprinting a layer, formed with varnish, on the toner image formed on the recording medium.

Recently, for the purpose of improving glossiness, water resistance, and friction (wear) resistance, of the toner image separately from the toner image, a varnish image using colorless and transparent varnish is overprinted superposedly on the toner image. As an apparatus capable of forming the varnish image, for example, a varnish applying apparatus of an ink jet type (called a varnish coater) is used. The varnish coater ejects varnish partially on the recording medium (so-called spot coating) and thus forms a varnish image desired by a user (Japanese Laid-Open Patent Application No. 2016-224111).

Incidentally, in general, when the varnish is applied onto a recording medium, surface glossiness increases. That is, at a portion where the varnish is applied, compared with a portion where the varnish is not applied, regular reflectance of light increases. For that reason, between a toner image on which the varnish is applied superposedly and a toner image on which the varnish is not applied superposedly, in the case where these toner images are visually compared with each other by the user, these toner images look different in color tint and texture. This is because in the case where the varnish is applied superposedly onto the toner image, the color tint and the texture of the toner image are influenced depending on a density of a base toner image and a film thickness and a line width of a varnish image and thus appearance of the toner images by the user changes. Incidentally, the film thickness and the line width of the varnish image change depending on an ejecting amount per unit area of the varnish and a degree of permeation of the varnish into the recording medium.

Therefore, the user actually outputted a recording medium on which a varnish image was formed superposedly on a toner image formed in advance on the recording medium and checked a color tint and a texture of the toner image on which the varnish image was formed superposedly by actually viewing the recording medium. However, in the conventional case, the user has to output recording mediums repetitively while appropriately changing the density of the toner image and the film thickness of the varnish image until the user can confirm a desired color tint and a desired texture, so that there was a liability that such an operation is troublesome and takes time, and the recording medium is liable to be wasted.

SUMMARY OF THE INVENTION

In view of the above-described problem, a principal object of the present invention is to provide an image forming system for outputting a test chart for grasping a color tint and a texture in the case where the varnish images are formed.

According to an aspect of the present invention, there is provided an image forming system comprising: an image forming unit configured to form an image on a recording medium; a varnish applying unit configured to apply varnish to the image on the recording medium; and a control unit configured to: control the image forming unit to form a first image and a second image; and control the varnish applying unit to apply varnish to the first image and the second image such that a first varnish application amount of the first image applied by the varnish applying unit is different from a second varnish application amount of the second image applied by the varnish applying unit.

According to another aspect of the present invention, there is provided an image forming system comprising: an image forming unit configured to form an image on a recording medium; a varnish applying unit configured to apply varnish to form a varnish image on the recording medium; and a control unit configured to control the image forming unit and the varnish applying unit, wherein the control unit is capable of executing an operation in an image forming mode for forming a varnish image by the varnish applying unit on the recording medium on which the toner is formed by the image forming unit and an operation in a test chart output mode for outputting a test chart on which a first test varnish image and a second test varnish image different in varnish application amount from the first test varnish image are formed by the varnish applying unit without executing formation of the image on the recording medium by the image forming unit.

Further features of the present invention will become apparent from the following description of exemplary embodiments with reference to the attached drawings.

Figure 6:
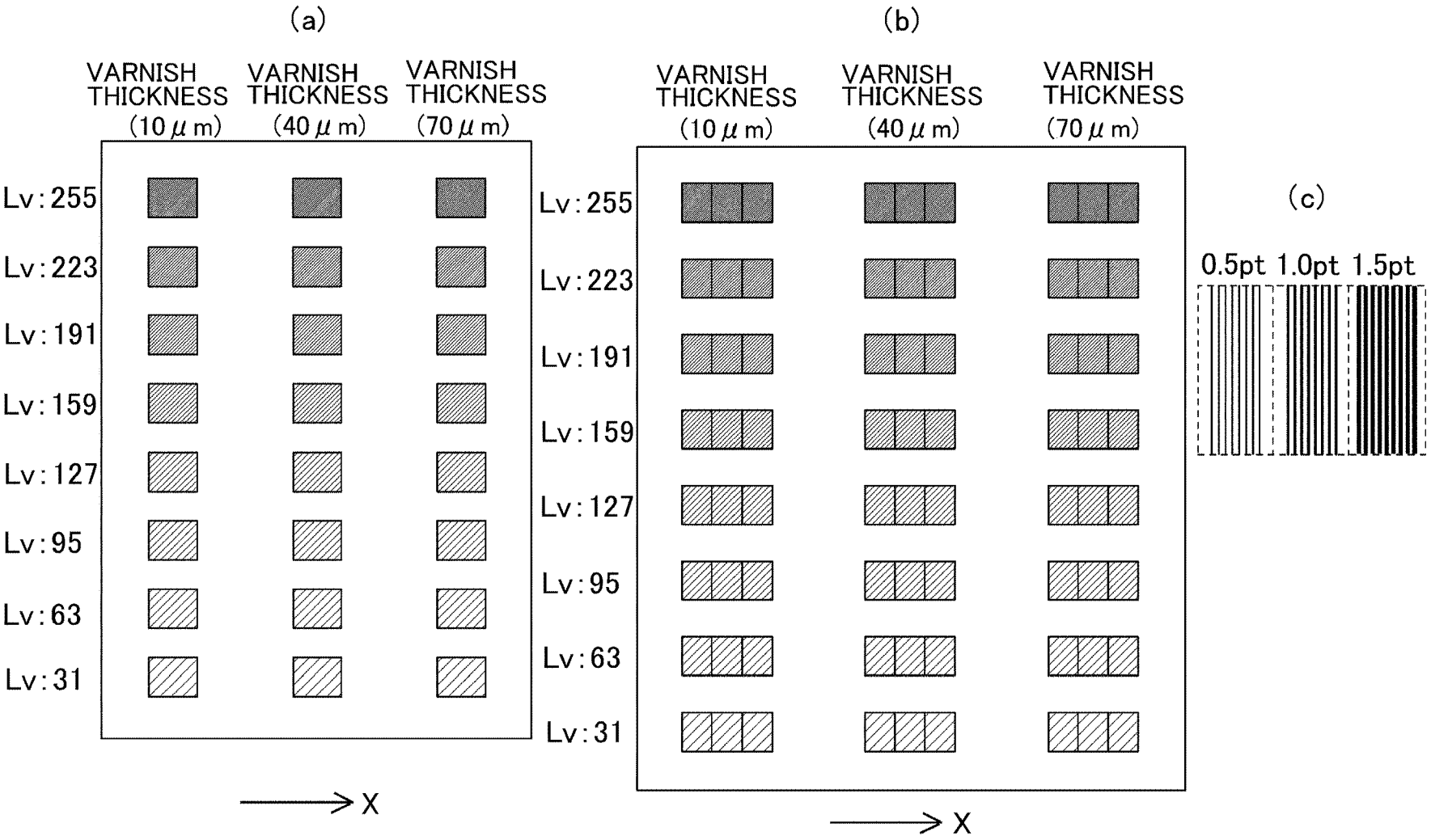

Part (a) of FIG. 6 is a schematic view showing a test chart on which a plurality of rectangular toner images are formed in a single color and with the same size.

Part (b) of FIG. 6 is a schematic view showing a test chart on which a plurality of toner images are formed in a single color with line patterns, and part (c) of FIG. 6 is an enlarged view of the line patterns.

Figure 7:
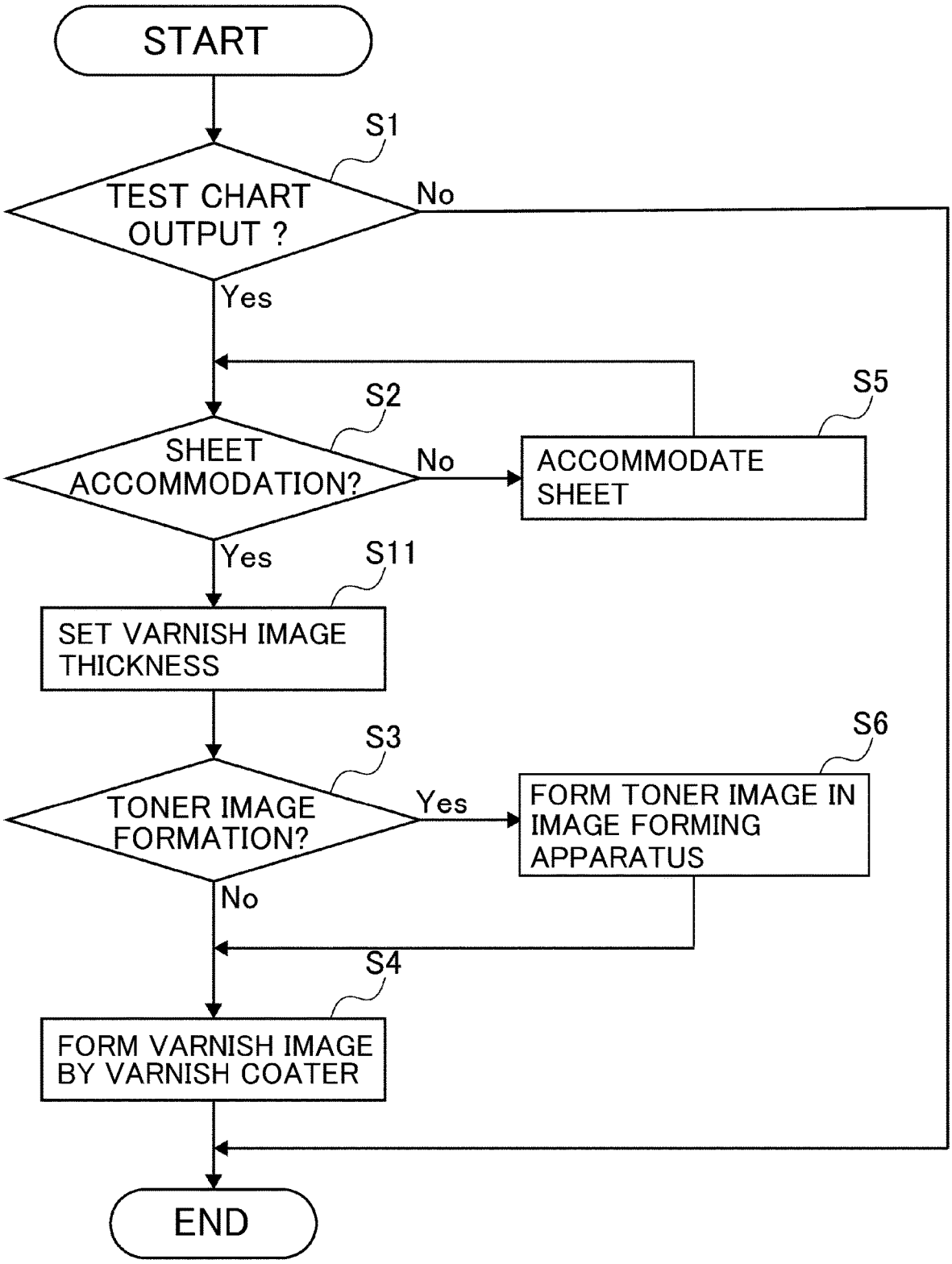

FIG. 7 is a flowchart showing a test chart output processing in a second embodiment.

Figure 8:
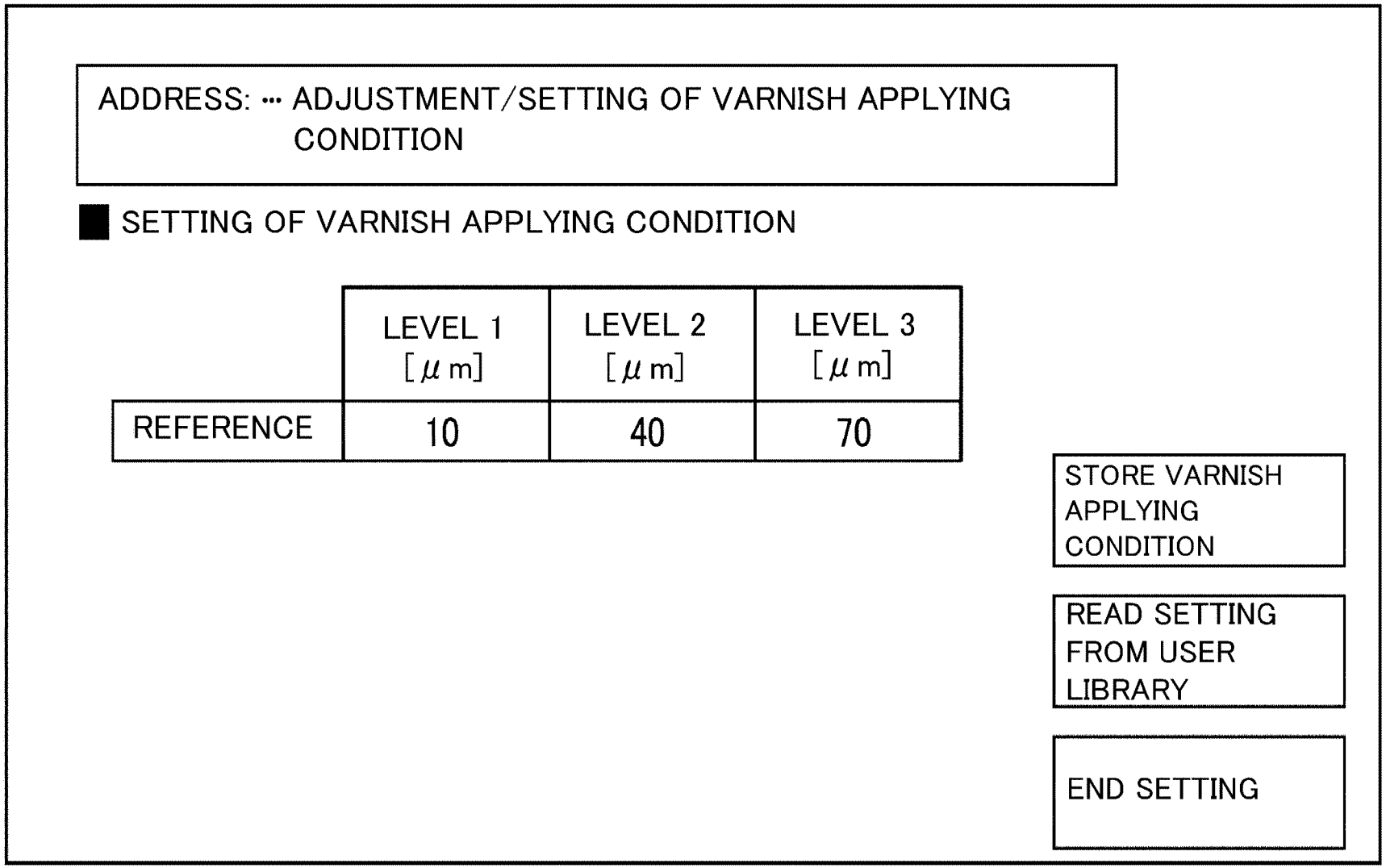

FIG. 8 is a schematic view showing a film thickness setting screen.

Figure 9:
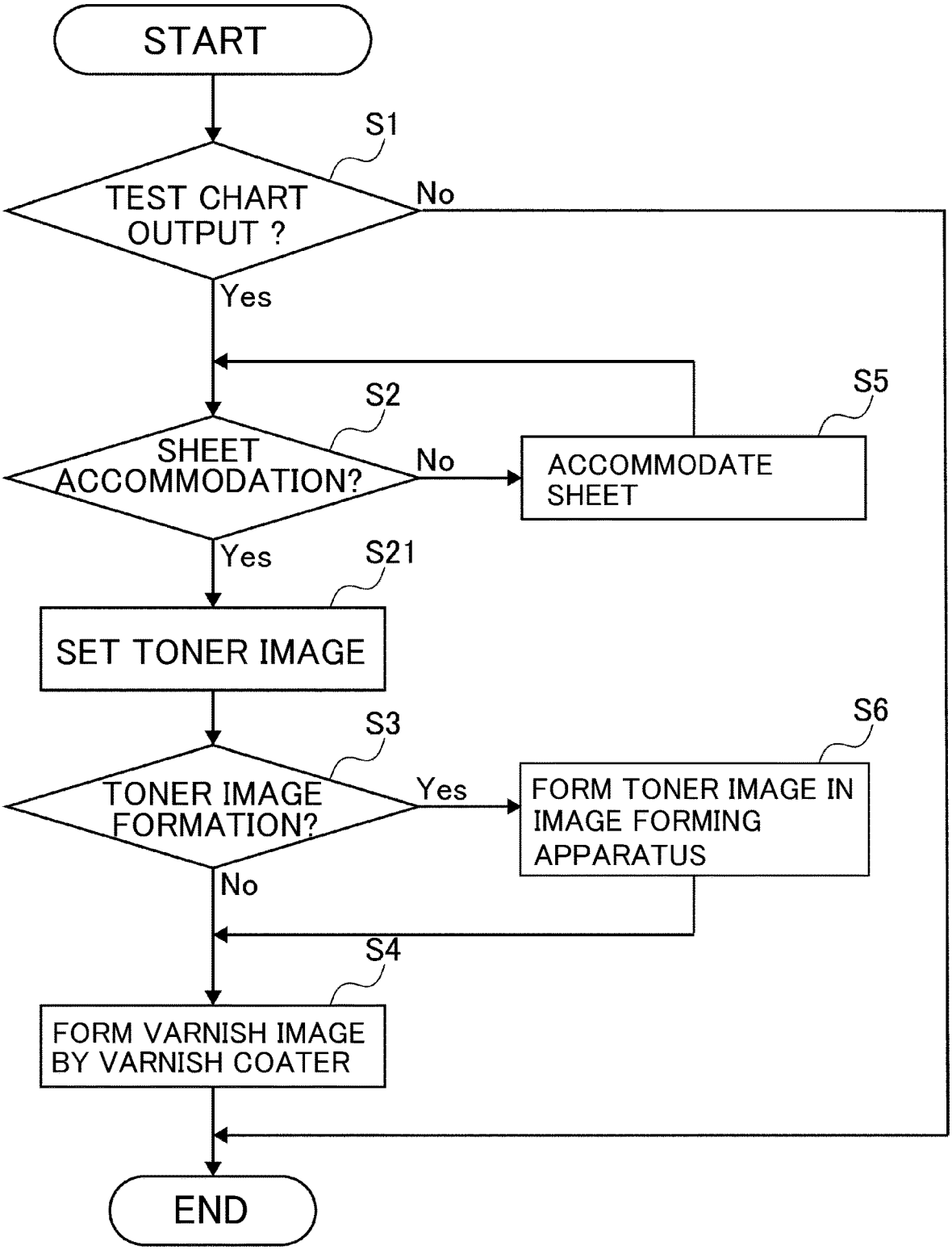

FIG. 9 is a flowchart showing a test chart output processing in a third embodiment.

Figure 10:
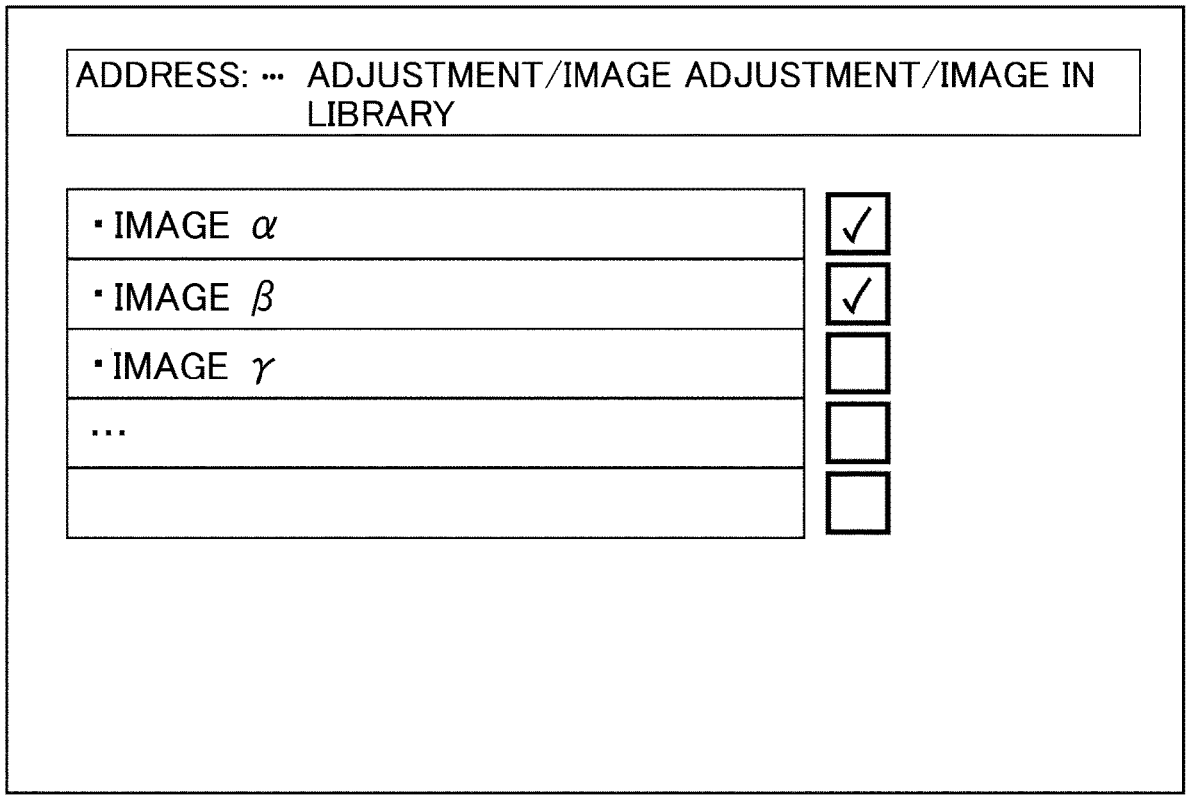

FIG. 10 is a schematic view showing a toner image selection screen.

DESCRIPTION OF THE EMBODIMENTS

First Embodiment

Figure 1:
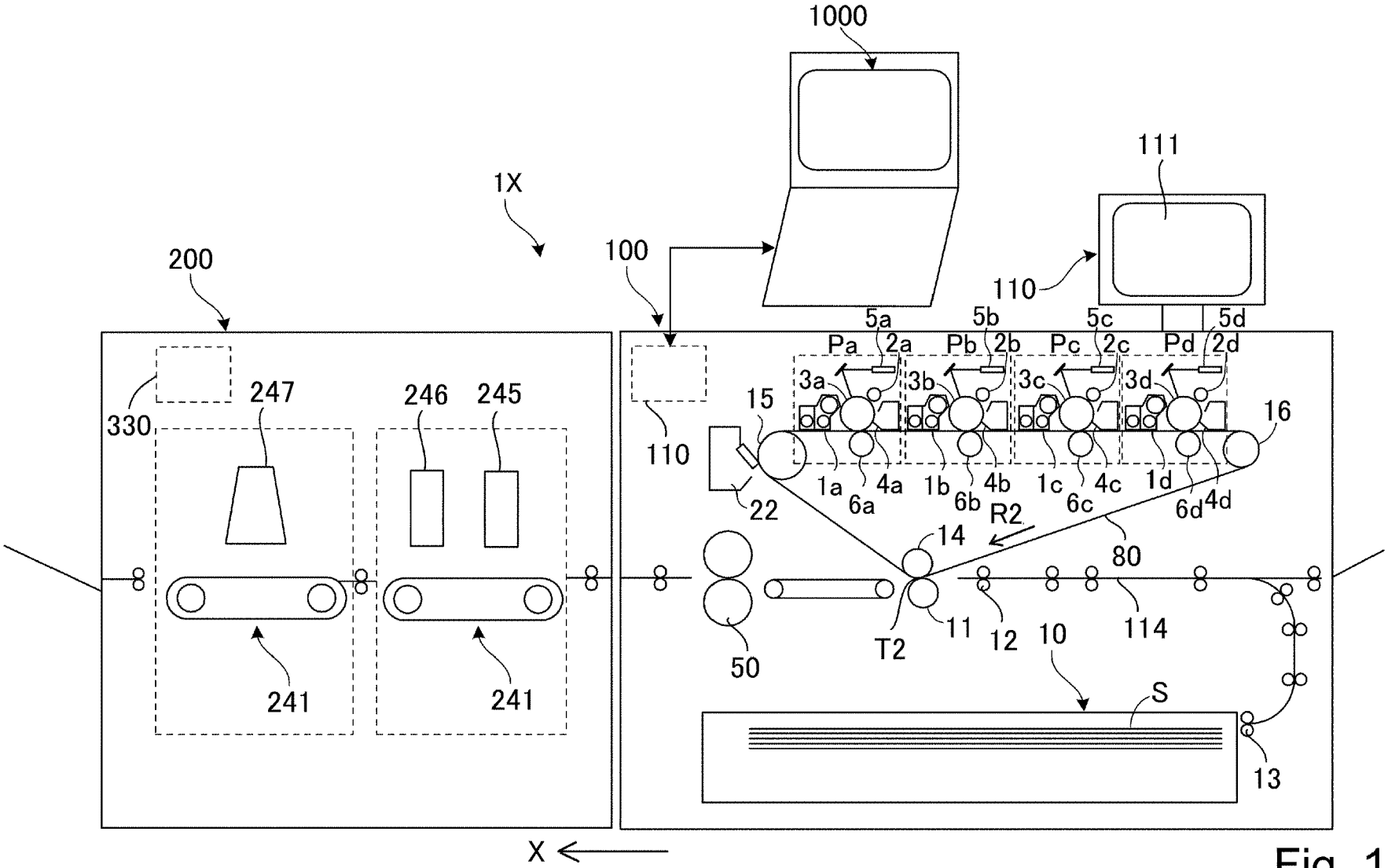
FIG. 1 is a schematic view showing a structure of an image forming system.

First, an image forming system 1X of this embodiment will be described using FIG. 1. The image forming system 1X shown in FIG. 1 includes an image forming apparatus 100 for forming a toner image on a recording medium S and a varnish applying apparatus (referred to as a varnish coater) 200 for forming a varnish image on the recording medium S. The varnish coater 200 is a post-step unit retrofittable to the image forming apparatus 100 for expanding function, and the image forming apparatus 100 and the varnish coater 200 are connected to each other so as to be capable of delivering the recording medium S therebetween. The image forming apparatus 100 and the varnish coater 200 are connected to each other by input/output interfaces (not shown) so as to be capable of sending and receiving control signals and data therebetween. The recording medium S, on which the toner image is formed by the image forming apparatus 100, is conveyed toward the varnish coater 200 for the purpose of improving glossiness, water resistance, friction resistance, and the like of the toner image formed on the recording medium S, so that the varnish image is formed on the recording medium S separately from the toner image by the varnish coater 200. Formation of the varnish image by the varnish coater 200 will be described later.

Incidentally, although illustration is omitted, the image forming system 1X may include another post-step unit, such as a relay apparatus, a finisher apparatus, or the like. The relay apparatus is disposed between the image forming apparatus 100 and the varnish coater 200, and reverses and sends the recording medium S, conveyed from the image forming apparatus 100, to the varnish coater 200 or sends the recording medium S to the varnish coater 200 after temporarily stacking the recording medium S. The finisher apparatus performs, for example, punching such that the recording medium S is perforated or stapling such that a plurality of recording mediums S are bundled and stapled, and then the perforated recording medium S or the bundle of the stapled recording mediums S is discharged. Further, in addition to these post-step units, for example, the image forming system 1X may include a recording medium supplying apparatus (not shown) capable of accommodating recording mediums S therein in a large amount, in which the recording medium S may be supplied from the recording medium supplying apparatus to the image forming apparatus 100.

<Image Forming Apparatus>

The image forming apparatus 100 will be described. The image forming apparatus 100 is an electrophotographic full-color printer of a tandem type. The image forming apparatus 100 includes image forming portions Pa, Pb, Pc, and Pd for forming images of yellow, magenta, cyan, and black, respectively. The image forming apparatus 100 forms a toner image on the recording medium S on the basis of data relating to the toner image included in image data sent from an original reading device (not shown) connected to, for example, the image forming apparatus 100 or from an external device 1000 such as a personal computer connected to the image forming apparatus 100. As the recording medium S, it is possible to cite sheet materials, such as plain paper, thick paper, roughened paper, uneven paper and coated paper.

A feeding process of the recording medium S in the image forming apparatus 100 will be described. The recording mediums S are accommodated in a cassette 10 in a stacked form, and are sent from the cassette 10 in synchronism with an image forming timing by a supplying roller 13. The recording medium S sent by the supplying roller 13 is conveyed toward a registration roller pair 12 provided in the course of a feeding (conveying) passage 114. Then, the recording medium S is subjected to oblique movement correction or timing correction by the registration roller pair 12, and thereafter, is sent to a secondary transfer portion T2. The secondary transfer portion T2 is a transfer nip formed by an inner secondary transfer roller 14 and an outer secondary transfer roller 11, and the toner image is transferred onto the recording medium S in response to application of a secondary transfer voltage to the outer secondary transfer roller 11.

As regards the recording medium S feeding process until the above-described secondary transfer portion T2, an image forming process of the image sent to the secondary transfer portion T2 at a similar timing will be described. First, although the image forming portions will be described, the respective color image forming portions Pa, Pb, Pc and Pd are constituted substantially similar to each other except that colors of toners used in developing devices 1*a*, 1*b*, 1*c* and 1*d* are yellow (Y), magenta (M), cyan (C), and black (K), respectively, which are different from each other. Thereafter, in the following, as a representative, the image forming portion Pd for black will be described, and other image forming portions Pa, Pb and Pc will be omitted from description.

The image forming portion Pd is principally constituted by the developing device 1*d*, a charging device 2*d*, a photosensitive drum 3*d*, a photosensitive drum cleaner 4*d*, an exposure device 5*d*, and the like. A surface of a rotating photosensitive drum 3*d* is electrically charged uniformly in advance by the charging device 2*d*, and thereafter, an electrostatic latent image is formed by the exposure device 5*d* driven on the basis of a signal of image information. Then, the electrostatic latent image formed on the photosensitive drum 3*d* is developed into a toner image with use of a developer by the developing device 1*d*.

Then, the toner image formed on the photosensitive drum 3*d* is primary-transferred onto an intermediary transfer belt 80 in response to application of a primary transfer voltage to a primary transfer roller 6*d* disposed opposed to the image forming portion Pd while sandwiching the intermediary transfer belt 80 therebetween. Primary transfer residual toner slightly remaining on the photosensitive drum 3*d* is collected the photosensitive drum cleaner 4*d*.

The intermediary transfer belt 80 is stretched by the inner secondary transfer roller 14, and stretching rollers 15 and 16, and is driven in an arrow R2 direction. In the case of this embodiment, the stretching roller 16 also functions as a driving roller for driving the intermediary transfer belt 80. The respective color image forming processes are carried out at timings when the associated toner image is superposedly transferred onto the upstream toner image primarily transferred onto the intermediary transfer belt 80. As a result, finally, a full-color toner image is formed on the intermediary transfer belt 80 and is conveyed to the secondary transfer portion T2. Incidentally, secondary transfer residual toner after passing through the secondary transfer portion T2 is removed from the intermediary transfer belt 80 by a transfer cleaner 22.

In the above, by the above-described feeding process and the above-described image forming process, in the secondary transfer portion T2, the timing of the recording medium S and the timing of the full-color toner image coincide with each other, so that secondary transfer is carried out. Thereafter, the recording medium S is conveyed to a fixing device 50, in which heat and pressure are applied to the recording medium S, so that the toner image is fixed on the recording medium S. The fixing device 50 nips and feeds the recording medium S on which the toner image is formed, and applies heat and pressure to the fed recording medium S, so that the fixing device 50 fixes the toner image on the recording medium S. That is, the toner of the toner image formed on the recording medium S is melted and mixed, and is fixed as the full-color image on the recording medium S. Thus, a series of the image forming processes is ended. Then, in the case of this embodiment, the recording medium S on which the toner image is fixed is conveyed from the image forming apparatus 100 to the varnish coater 200.

In this embodiment, a two-component developer containing the toner and a carrier is used. The toner contains a binder resin, a colorant, and a parting agent (wax). As the binder resin, a known binder resin can be used. For example, it is possible to use resin materials such as a vinyl copolymer represented by a styrene-(meth)acrylic copolymer, a polyester resin, a hybrid resin obtained by chemically bonding a vinyl copolymer unit and a polyester unit to each other, an epoxy resin, a styrene-butadiene copolymer, and the like. As the colorant, it is possible to use known colorants for yellow, magenta, cyan, and black, respectively.

As the parting agent, for example, it is possible to cite aliphatic hydrocarbon waxes such as low-molecular weight polyethylene, low-molecular weight olefin copolymer wax, microcrystalline wax, Fischer-Tropsch wax, and paraffin wax; oxide of the aliphatic hydrocarbon wax such as oxidized polyethylene wax; their block copolymers; waxes principally containing fatty acid esters such as carnauba wax and montanic acid ester wax; ester wax which is synthetic reaction product between higher aliphatic acid, such as behenyl behenate or behenyl stearate, and higher alcohol; fatty acid esters a part or all of which is deoxidized, such as deoxidized carnauba wax; and the like.

In the case of this embodiment, in the image data, data relating to the varnish image formed by the varnish coater 200 is also contained. That is, the data relating to the varnish image is set separately from data relating to the toner images of the four colors YMCK. In the data relating to the varnish image, similar to the data relating to the toner images of the four colors of YMCK, for each of pages, an individual varnish image is associated with a coordinate of an image forming region on the recording medium S.

Figure 2:
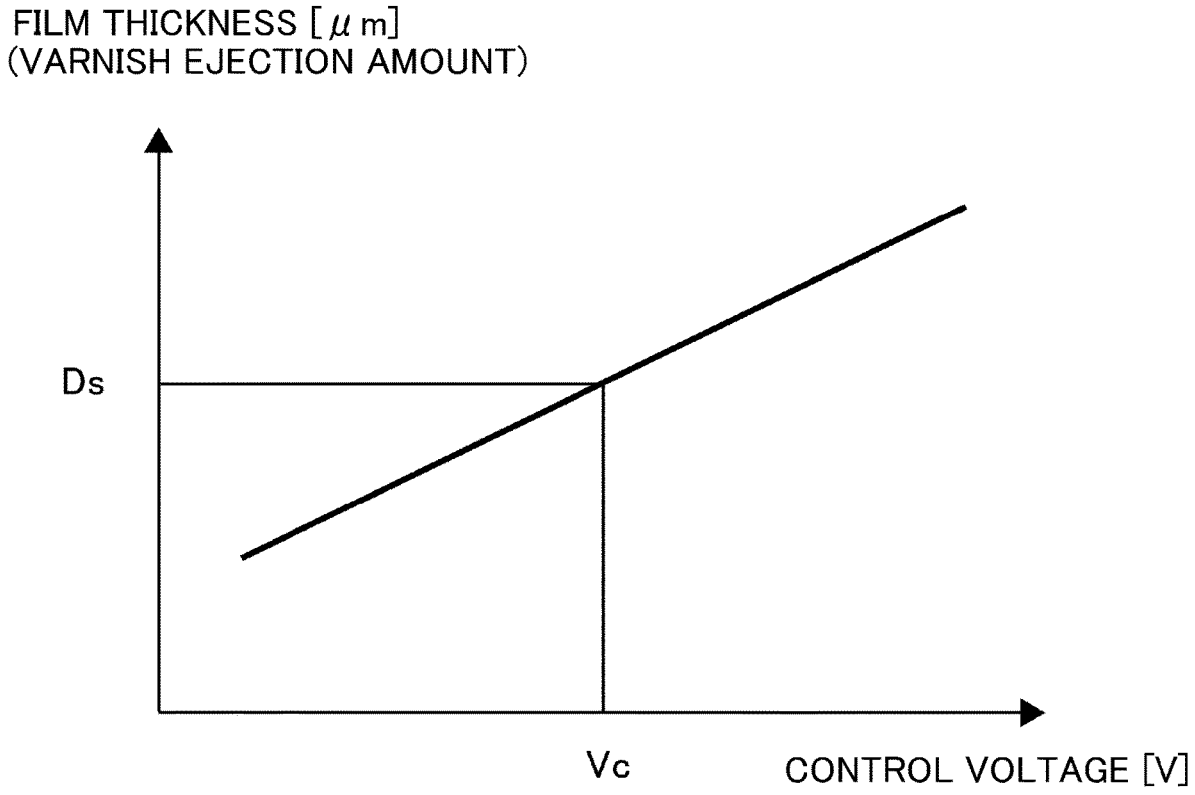
FIG. 2 is a graph showing a relationship between a control voltage and a film thickness which relate to varnish image formation.

Next, the varnish coater 200 will be described using FIGS. 1 and 2. The varnish coater 200 is a varnish applying apparatus of an ink jet type capable of forming varnish images such as characters, diagrams, graphics, and the like, which are desired by users. In the case of the ink jet type, varnish in the form of droplets is ejected toward the recording medium S, so that the varnish is deposited on the recording medium S and thus the varnish image is formed. The varnish coater 200 is capable of forming the varnish image on the basis of data relating to the varnish image. Incidentally, in the following, the varnish coater 200 for forming the varnish image with use of a colorless and transparent varnish liquid (for example, ultraviolet (UV)-curable UV varnish) solidified by UV irradiation will be described as an example.

The varnish coater 200 includes a sheet feeding portion 241, a position detecting portion 245, a varnish ejecting portion 246, and a varnish solidifying portion 247. The sheet feeding portion 241 feedings the recording medium S while attracting the recording medium S to a belt feeding surface by an air sucking device (not shown) through holes formed in a feeding belt 242. Along a sheet feeding passage of this sheet feeding portion 241, in an order from an upstream side toward a downstream side of a feeding direction (arrow X direction) of the recording medium S, the position detecting portion 245, the varnish ejecting portion 246, and the varnish solidifying portion 247 are disposed. The position detecting portion 245 is a detecting portion using a CCD, or the like, for example, and with respect to the recording medium S fed while being sucked on the belt feeding surface, the position detecting portion 245 detects each of a position of a leading end of the recording medium S with respect to the feeding direction, a position of each of opposing end portions with respect to a widthwise direction, and a position of the toner image on the recording medium S. The position of the toner image is detected by the position detecting portion 245, so that the varnish coater 200 is capable of overprinting the varnish image superposedly on the toner image.

The varnish ejecting portion 246 forms the varnish image on the recording medium S by ejecting the varnish onto one surface (side) of the recording medium S fed by the sheet feeding portion 241. The varnish ejecting portion 246 includes a plurality of print heads (not shown). The print heads are, for example, heads of a line type, in which a plurality of ejection ports (not shown) are arranged and disposed in the widthwise direction crossing the feeding direction of the recording medium S. A varnish ejecting method of the print heads may employ a type using heat generating elements, a type using piezo electric elements, a type using electrostatic elements, a type using MEMS elements, and the like. Although illustration is omitted, the varnish is supplied from a tank to the associated one of the print heads through a tube.

A film thickness of the varnish image is influenced by an application amount per unit area of the varnish onto the recording medium S. The varnish amount (varnish application amount) can be changed by adjusting a varnish ejecting amount from the print heads. For example, in the case of the type using the piezoelectric elements, as shown in FIG. 2, the varnish ejection amount varies depending on adjustment of a control voltage, and the film thickness of the varnish image is adjusted depending on an increase and a decrease in varnish ejection amount per unit area. In the case of this embodiment, the film thickness of the varnish image is adjusted in a range of, for example, "5-100 μm", preferably "10-70 μm". Further, a line width of the varnish image is adjusted depending on the number of ejection ports, of a plurality of ejection ports, used as the ejection portions through which the varnish is ejected. For example, adjustment is made so that the number of the ejection ports used as the ejection ports through which the varnish is ejected is increased in the case where the line width of the varnish image is made thick (wide) and is decreased in the case where the line width of the varnish image is made thin (narrow).

Further, a resolution of the varnish image capable of being formed by the varnish coater 200 is, for example, 600 dpi, and in that case, the line width of the varnish image is adjusted in a 600 dpi unit. Incidentally, the above-described range of the film thickness of the varnish image, the resolution of the varnish image, and an adjusting range of the line width of the varnish image may be appropriately changed depending on the varnish ejecting method of the print heads, a kind of the varnish, and the like.

Returning to FIG. 1, the recording medium S on which the varnish image is formed on one surface thereof by the varnish ejecting portion 246 is sent by the sheet feeding portion 241 to the varnish solidifying portion 247 positioned downstream of the varnish ejecting portion 246 with respect to the feeding direction, and then the varnish on the recording medium S is solidified by the varnish solidifying portion 247. The varnish solidifying portion 247 as the UV irradiation portion includes a UV lamp, and the UV lamp irradiates the varnish with UV light (rays) of a wavelength corresponding to the varnish. The UV lamp is disposed in an almost entire region of the recording medium S with respect to the widthwise direction so as to be capable of emitting the UV light (UV radiation), and is turned on only during passing of the recording medium S. As described above, the varnish image is capable of being overprinted superposedly on the toner image formed on the recording medium S.

Incidentally, in this embodiment, the UV varnish is used as the varnish, but the present invention is not limited thereto, and if oil varnish or aqueous varnish is used, in order to solidify the varnish, it is desirable that an IR (infrared ray) lamp, not the UV lamp, is used. Further, the varnish may be solidified by warm air or by the IR lamp and the warm air in combination.

Next, a control constitution in the image forming system 1X will be described using FIG. 3 while making reference to FIG. 1. In this embodiment, the image forming apparatus 100 (specifically, the main controller 101) unitarily manages and controls an operation instruction to the varnish coater 200. Incidentally, to a main controller 101 and a varnish processing controller 330 which are described later, in addition to the devices (portions) illustrated in FIG. 3, various devices such as motors and power sources are connected, but are not the main object of the present invention herein, and therefore, will be omitted from illustration and description.

Figure 3:
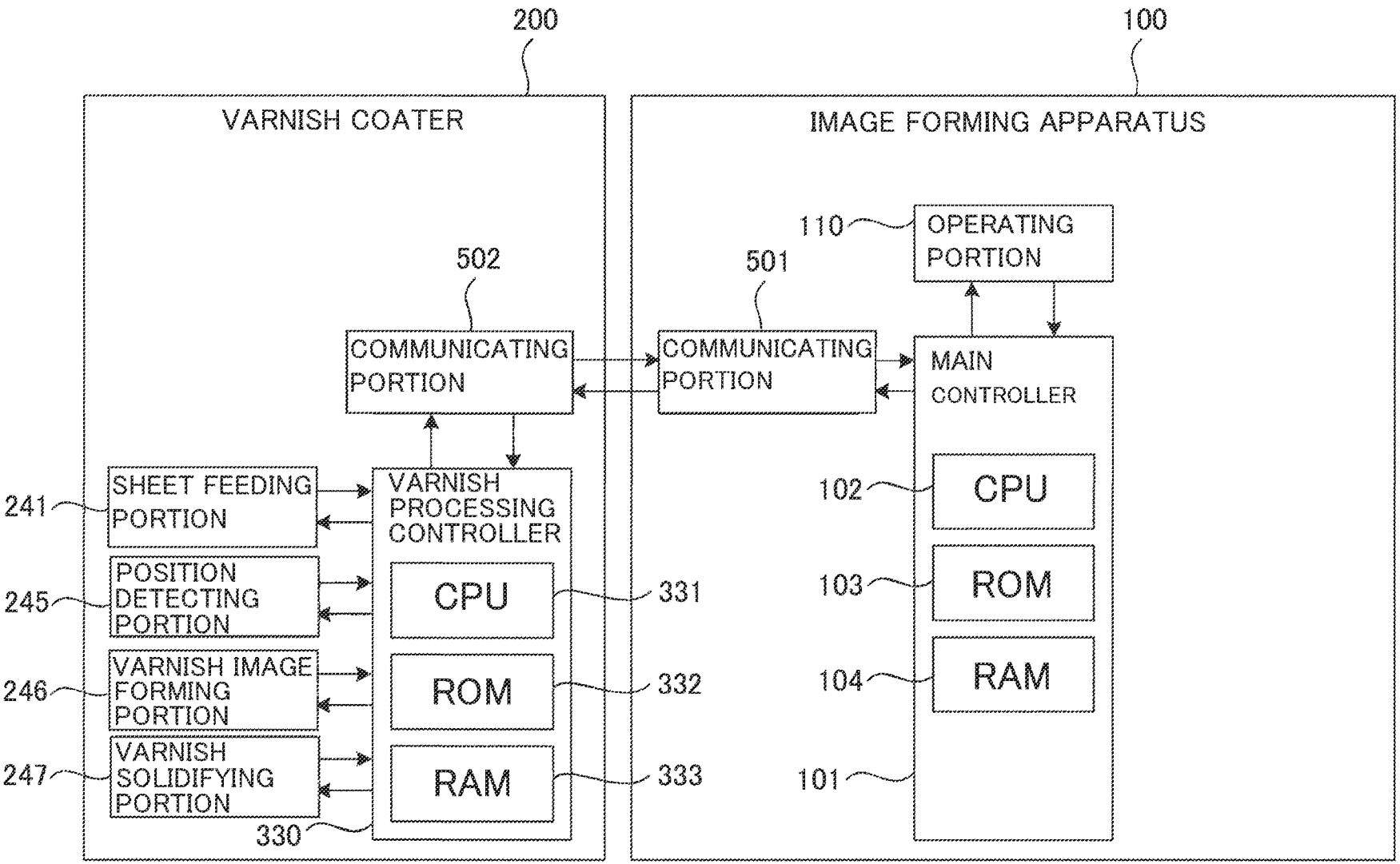
FIG. 3 is a control block diagram of an image formation control system in the image forming system.

In the image forming system 1X of this embodiment, as shown in FIG. 3, to the main controller 101 as a control unit, the varnish processing controller 330 is connected via communication cables portions 501 and 502 so as to be capable of communicating operation instructions and various data. In accordance with the operation instructions from the main controller 101, the varnish processing controller 330 causes the varnish coater 200 to operate. That is, while the main controller 101 controls the operation of the image forming apparatus 100, the main controller 101 is capable of controlling entirety of the image forming system 1X including the varnish coater 200 by sending the operation instructions and the various data to the varnish coater 200.

The above-described main controller 101 and the above-described varnish processing controller 330 may have the same constitution. For example, each of the controllers includes a CPU (central processing unit), a ROM (read only memory), and a RAM (random access memory).

The main controller 101 includes the CPU 102, the ROM 103, and the RAM 104. In the ROM 103, in addition to, for example, image forming processing (not shown), various programs and the like for "test chart output processing" (see FIG. 4, 7 or 9) (described later) are stored. In the RAM 104, various data such as test data relating to test toner images and test data relating to varnish is images, which are formed on a test chart (described later), are stored. Incidentally, the RAM 104 is capable of temporarily storing a calculation (computation) processing result or the like during execution of the various programs.

The image forming apparatus 100 includes an operating portion 110 including, for example, a liquid crystal display portion 111 (see FIG. 1), and the operating portion 110 is connected to the main controller 101. The operating portion 110 as a selecting portion or an input portion is, for example, a touch panel. On the liquid crystal display portion 111, various screens presenting the various programs and various data or the like can be displayed by the operating portion 110. Further, the operating portion 110 receives input of a start of the various programs and input of the various data, and the like, depending on a screen touch operation by a user. On the touch panel, a screen including various buttons, switches, and the like as software switches can be displayed.

The user is capable of inputting a start of various programs for an operation in an "image forming mode", and operation in "test chart output mode", and the like from the operating portion 110. In the case where the start of the operation in the "image forming mode" is inputted, the CPU 102 executes the image forming processing (program) stored in the ROM 103. In the case where the start of the operation in the "test chart output mode" is inputted, the CPU 102 executes the test chart output processing (program) stored in the ROM 103. With this execution, together with the image forming apparatus 100, the varnish coater is capable of being operated. The image forming apparatus 100 forms the toner image on the recording medium S on the basis of data relating to the toner image, and the varnish coater 200 forms the varnish image on the recording medium S on the basis of data relating to the varnish image.

On the operating portion 110, various screens such as a test chart selection screen (FIG. 5), a film thickness setting screen (FIG. 8), an image selection screen (FIG. 10), and the like, which are described later are displayed. The user is capable of performing selection of the test chart, setting of the film thickness of the varnish image (varnish ejection amount), and selection of the toner image from these screens as described later.

The varnish processing controller 330 includes a CPU 331, a ROM 332, and a RAM 333. The CPU 331 causes the sheet feeding portion 241, the position detecting portion 245, the varnish ejecting portion 246, and the varnish solidifying portion 247 of the varnish coater 200 to operate on the basis of a control program stored in the ROM 332. To the varnish processing controller 330, data relating to the varnish image contained in the image data is sent from the main controller 101, and the varnish processing controller 330 causes the RAM 333 to store this data. The varnish coater 200 executes the varnish applying processing for forming the varnish image on the recording medium S, on the basis of the data relating to the varnish image.

<Test Chart Output Processing>

In this embodiment, the test chart is outputted on the basis of the image data for the test chart. The test chart has a plurality of images created by applying varnish. Therefore, next, the "test chart output processing" in the first embodiment will be described using FIG. 4 to part (c) of FIG. 6 while making reference to FIGS. 1 and 3. The "test chart output processing" is repetitively executed by the main controller 101 (see FIG. 3) with input of the start of the operation in the "test chart output mode".

Figure 4:
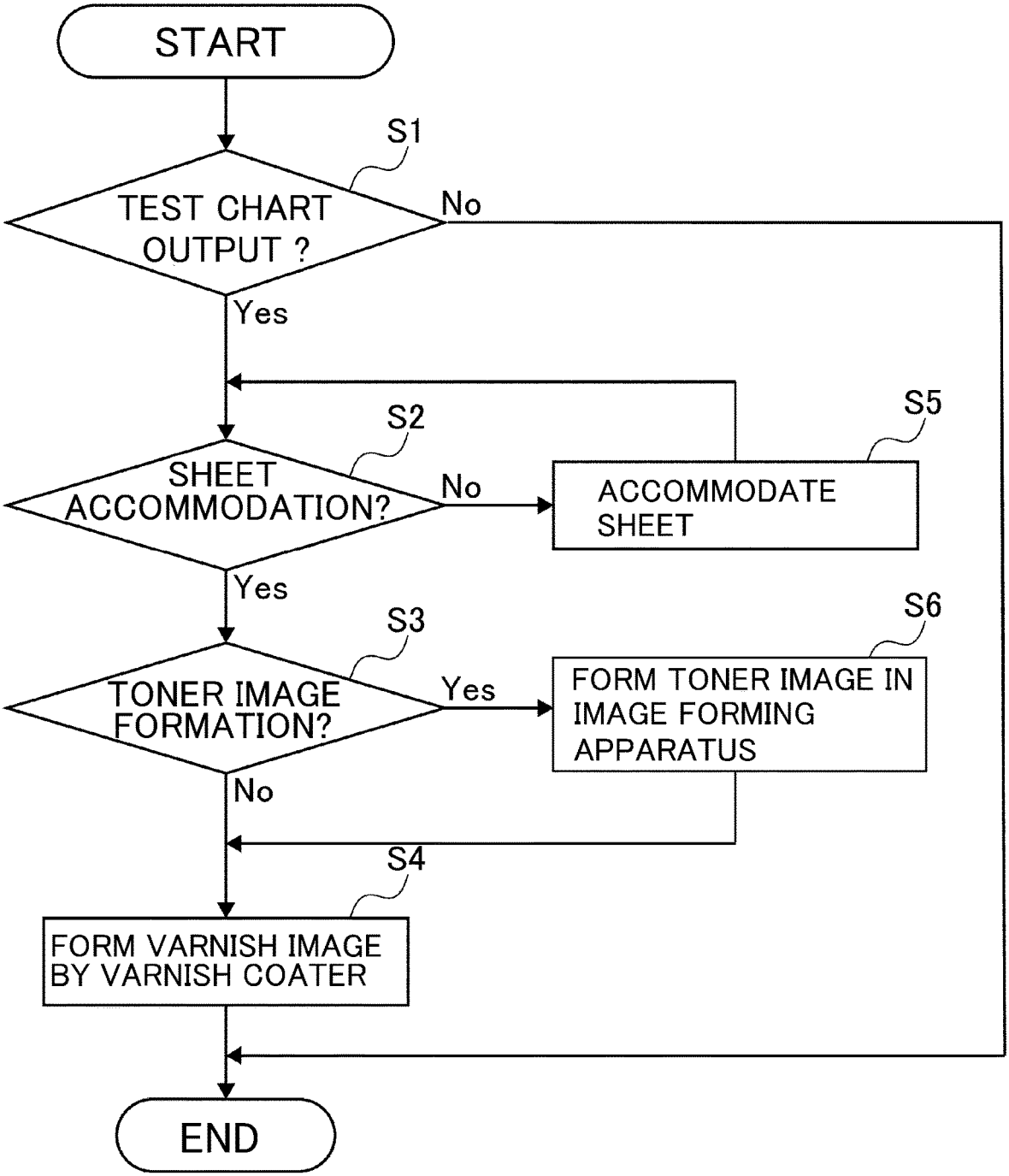
FIG. 4 is a flowchart showing a test chart output processing in a first embodiment.

As shown in FIG. 4, the main controller 101 discriminates whether or not the test chart is outputted (S1). Whether or not the test chart is outputted is discriminated depending on whether or not, for example, a "test button" displayed on the operating portion 110 is operated by the user. In the case where the "test button" is not operated and the test chart is not outputted (No of S1), the main controller 101 ends the processing without outputting the test chart.

In the case where the "test button" is pressed and the test chart is outputted (Yes of S1), the main controller 101 causes the operating portion 110 to display the "test chart selection screen" (FIG. 5) and discriminates whether or not the recording medium S is accommodated in the cassette 10 (S2). Here, the recording medium S accommodated in the cassette 10 may preferably be a recording medium S actually used for forming a desired image on the recording medium S by the user. In the case where the recording medium S is not accommodated in the cassette 10 (No of S2), the main controller 101 stands by until the recording medium S is accommodated in the cassette 10 (S5). At that time, the main controller 101 may notify the user of a message to the effect that the recording medium S is accommodated in the cassette 10 by causing the liquid crystal display portion 111 to display the message.

<Test Chart Selection Screen>

Figure 5:
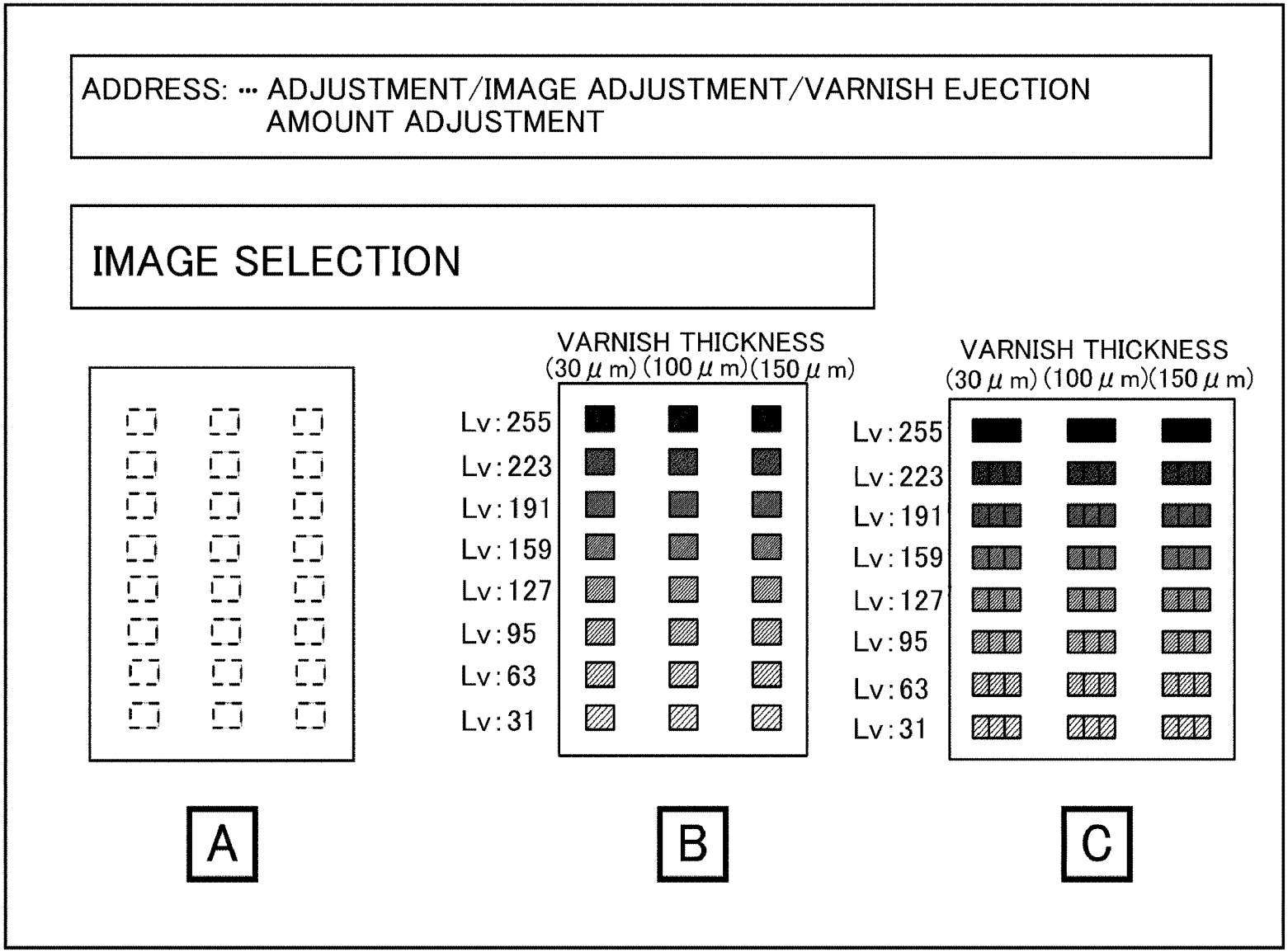
FIG. 5 is a schematic view showing a test chart selection screen.

In FIG. 5, the "test chart selection screen" displayed during the execution of the operation in the test chart output mode is shown. On the "test chart selection screen" shown in FIG. 5, an "A" button, a "B" button, and a "C" button are displayed in the listed order from a left-hand side. Further, on a side above these buttons on the screen, output forms (in a word, samples) of the test chart outputted in the case where the respective buttons are operated are displayed.

The user is capable of determining the test chart to be outputted. When any one of the "A" to "C" buttons is operated, the associated test chart is outputted.

In the case where the "A" button is operated, the toner image is not formed, and as an output form, a recording medium S on which only varnish images formed in a plurality of kinds of film thicknesses are formed is outputted. That is, the image forming apparatus 100 does not form the toner image and only supplies the recording medium S to the varnish coater 200, and then the varnish coater 200 forms the varnish image on a blank recording medium S supplied from the image forming apparatus 100. In this embodiment, as the varnish image, a varnish image shown in part (a) or part (b) of FIG. 6 is used. A difference between a test chart "A" and test charts "B" and "C" is the presence or the absence of the toner image.

Output forms of the test charts in the case where the "B" button is operated and in the case where the "C" button is operated will be described using parts (a) and (b) of FIG. 6. Part (a) of FIG. 6 shows an example of the output form of the test chart in the case where the "B" button is operated, and part (c) of FIG. 6 shows an example of the output form of the test chart in the case where the "C" button is operated.

The test chart shown in part (a) of FIG. 6 is an A4-size test chart including a plurality of test toner images which are single-color certain-area images with different densities and including a varnish image superposed on each of the test toner images. In this embodiment, as the test toner images, patch images of the same color formed in the same size and in a rectangular shape are used. Each of the patch images is formed in a square of 25 mm on each side. Further, density gradation from 0 to 255 obtained by dividing the density in a digital manner is used, and these gradation levels are divided into 8 stages (Lv: 31, 63, 95, 127, 159, 191, 223, 255) every 32 gradation levels, so that patch images as a first test toner image and a third test toner image are formed and arranged in a longitudinal direction (widthwise direction crossing the feeding direction of the recording medium S).

In the test chart, in the feeding direction (arrow X direction), as the first test toner image (first image) and a second test toner image (second image), patch images with the same density are formed side by side. Here, the patch images with the same density refer to toner images formed with the same density data. The reason why the plurality of patch images with the same density are formed and arranged in the feeding direction is because, as the varnish images superposed on the patch images, if varnish images with different film thicknesses are formed by ejecting varnish in different ejection amounts (different varnish application amounts) with respect to the feeding direction, the user is enabled to actually look at the test chart and to easily compare differences in color tint and texture of the toner images changing depending on the film thicknesses of the varnish images. In this embodiment, these patch images as the toner images with the same device are formed, and then three varnish images are formed so that the varnish images formed superposedly on the patch images, respectively are different in film thickness from each other. In this embodiment, as reference setting of a varnish ejection amount, the film thickness of the varnish image is set at three levels of "10 μm, 40 μm, 70 μm".

The test chart shown in part (b) of FIG. 6 is an A4-size test chart including a plurality of test toner images which are single-color certain-area images with different densities and including a varnish image superposed on each of the test toner images. Here, as regards the varnish images shown in part (b) of FIG. 6, as shown in part (c) of FIG. 6, when the varnish images with the same film thicknesses are formed superposedly on the toner images with the same density, the varnish images are formed with a plurality of line widths. That is, in part (b) of FIG. 6, in addition to formation of the varnish images with different film thicknesses, the varnish images with different line widths are formed. A plurality of rectilinear lines forming line width patterns of the varnish images are formed with line widths of "0.5 pt, 1.0 pt, 1.5 pt", for example, as shown in part (c) of FIG. 6. Incidentally, in this embodiment, the rectilinear lines formed along the longitudinal direction are shown as an example, but rectilinear lines formed along the feeding direction or rectilinear lines formed obliquely may be used.

The above-described patch images as the test toner images are formed and arranged in the longitudinal direction by being divided into 8 levels every 32 gradation levels in density similarly as in the test chart shown in part (a) of FIG. 6. Further, in the feeding direction (arrow X direction), the patch images with the same density are formed and arranged.

In this embodiment, the film thickness of the varnish image is set at the three levels of "10 μm, 40 μm, 70 μm", but the levels are not necessarily limited to these numerical values and are not limited to the three levels. Further, the line width of the varnish image is set at the three levels of "0.5 pt, 1.0 pt, 1.5 pt", but the levels are not necessarily limited to these numerical values and are not limited to the three levels. Further, in this embodiment, in part (b) of FIG. 6, a constitution in which the test chart on which the varnish images relating to the plurality of levels in film thickness and line width are formed is outputted was described, but a constitution in which a test chart on which a plurality of levels in only one of the film thickness and the line width are used is outputted may be employed. Further, the film thickness of the varnish image applied on the recording medium S changes depending on a degree of permeation of the varnish into the recording medium S, and the degree of permeation of the varnish varies depending on a kind of the recording medium S. In this embodiment, as the recording medium S used as the test chart, a recording medium S ("OK Top Coat", basis weight: 157 g/m$^2$, A4 size (feeding direction length: 210 mm, longitudinal direction length: 297 mm), manufactured by Oji Paper Co., Ltd.) was employed. In general, as regards the recording medium S on which the varnish is applied, a recording medium S subjected to surface coating, such as art paper, coated paper or cast paper is assumed, and a recording medium S not subjected to the surface coating, such as so-called high quality paper or plain paper, is not assumed. This is because the recording medium S not subjected to the surface coating is large in degree of permeation of the varnish into the recording medium S and thus there is a liability that the recording medium S is easily deformed with permeation of the varnish.

Incidentally, the size and the shape of the patch image are not limited to those described above, and for example, symbols such as characters may be used. Further, the color of the patch image is not limited to black (single color), but may be another single color such as yellow, magenta, or cyan or may be a mixed color of these colors. Further, the patch image arrangement is not limited to the arrangement in which the patch images formed in the same color are arranged side by side, but an arrangement in which patch images formed in colors of black, yellow, magenta, and cyan, respectively, may be arranged side by side may be employed. Further, a constitution in which the first test toner image and the second test toner image which have the same density are not formed with an interval therebetween and in which varnish images different in film thickness or line width may be formed on a common test toner image may be employed. That is, the first test toner image and the second test toner image may be formed in a continuous state.

Returning to the description of FIG. 4, in the case where the recording medium S is accommodated in the cassette 10 (Yes of S2), the main controller 101 causes the operating portion 110 to display the "test chart selection screen" (see FIG. 5), and discriminates whether or not the toner image is formed on the test chart (S3). That is, whether or not the toner image is formed on the test chart is discriminated by whether or not the button selected by the user in the "test chart selection screen" is any one of the "A" to "C" buttons. In the case where the "A" button is operated, discrimination that the toner image is not formed for outputting the test chart on which the toner image is not formed and only the varnish image is formed is made. On the other hand, in the case where the "B" button or the "C" button is operated, discrimination that the toner image is formed for outputting the test chart on which the toner image and the varnish image are formed as shown in part (a) or (b) of FIG. 6 is made.

In the case where the toner image is not formed (No of S3), the main controller 101 causes the image forming apparatus 100 to convey the recording medium S to the varnish coater 200 without causing the image forming apparatus 100 to form the toner image on the recording medium S, and causes the varnish coater 200 to form the varnish image on the recording medium S (S4). On the other hand, in the case where the toner image is formed (Yes of S3), the main controller 101 causes the image forming apparatus 100 to form the toner image on the recording medium S (S6). Thereafter, the main controller 101 causes the image forming apparatus 100 to convey the recording medium S, on which the toner image is formed, to the varnish coater 200, and causes the varnish coater 200 to form the varnish image on the recording medium (S4). Thus, the test chart in the output form selected on the "test chart selection screen" by the user is outputted.

As described above, in this embodiment, when the user evaluates a change in color tint and texture of the toner image by the varnish which cannot be obtained until the varnish is actually applied superposedly onto the toner image, the operation in the test chart output mode in which the test chart is outputted is capable of being executed. On the test chart, a plurality of varnish images are formed on a single recording medium S with different film thicknesses, so that the user looks at the test chart and thus is capable of grasping the difference in color tint and texture of an output product in the case where the varnish images are formed. By this, the user can reduce a time required for checking an image quality in the case where the varnish images are formed superposedly on the toner images, so that productivity of the user is improved. Further, the recording medium S is not consumed uselessly, so that a cost-reduction effect can be obtained.

Second Embodiment

In the above-described first embodiment, as shown in parts (a) and (b) of FIG. 6, the three levels of the film thicknesses of the varnish images were set in advance, but the present invention is not limited thereto, and the user may arbitrarily set the varnish image film thickness in a predetermined range (for example, 5-100 μm). Therefore, a "test chart output processing" in a second embodiment in which the user is capable of arbitrarily setting the varnish image film thickness will be described using FIGS. 7 and 8. In the following, the second embodiment will be described, but as regards processing which is the same as the processing in the above-described first embodiment, the same reference numerals or symbols are used, and description thereof will be briefly made or omitted.

The "test chart output processing" in the second embodiment shown in FIG. 7 is substantially the same as the "test chart output processing" in the first embodiment shown in FIG. 4 in processes of steps S1 to S6. However, in the case where the recording medium S is accommodated in the cassette 10 (Yes of S2), the main controller 101 causes the operating portion 110 to display a "film thickness setting screen" (FIG. 8), and makes setting of an applied film thickness in accordance with an operation of the "film thickness setting screen" by the user (S11). Thereafter, the main controller 101 causes the operating portion 110 to display the "test chart selecting screen" (see, FIG. 5), and discriminates whether or not the toner image is formed on the test chart in accordance with an operation of the "test chart selecting screen" by the user (S3).

<Film Thickness Setting Screen>

In FIG. 8, the "film thickness setting screen" is shown. As shown in FIG. 8, in the "film thickness setting screen", as regards the film thicknesses of the varnish images formed on the test chart, three input boxes (fields) (varnish application amount levels 1, 2, and 3) into which the user is capable of inputting arbitrary values are provided. In FIG. 8, as default values of the film thicknesses of the varnish images, display is made so that the level 1 is "10 μm", the level 2 is "40 μm", and the level 3 is "70 μm". In this embodiment, in these input boxes, the user is capable of manually inputting arbitrary setting values within, for example, a range of "5-100 μm". The user inputs the setting values and then operates an "END SETTING" button, so that the setting values are finalized.

Further, in this embodiment, the user operates a "STORE VARNISH APPLYING CONDITION" button, whereby the above-described setting values can be stored as a user library in the RAM 104 (see FIG. 3) or the like. Further, the user operates a "READ SETTING FROM USER LIBRARY" button, whereby the setting values stored in the RAM 104 (see FIG. 3) or the like can be read and utilized.

As described above, in the second embodiment, the test chart was capable of being outputted by arbitrarily adjusting the varnish application amount by the user. By this, the user can more easily grasp the change in color tint and texture of the toner image due to the difference in film thickness of the varnish image, so that the user can easily seek the film thickness of a desired varnish image. By this, the user can reduce a time required for checking an image quality in the case where the varnish images are formed superposedly on the toner images, with the result that productivity of the user can be further improved. Incidentally, in the second embodiment, the varnish image film thickness can be arbitrarily adjusted by the user, but the line width of the varnish image may be capable of being arbitrarily adjusted by the user. Even in this case, the user can more easily grasp the change in color toner image and texture due to the difference in film thickness of the varnish image, so that the user can easily seek the film thickness of a desired varnish image. By this, the user can reduce a time required for checking an image quality in the case where the varnish images are formed superposedly on the toner images, with the result that productivity of the user can be further improved.

Third Embodiment

In the above-described first embodiment, as shown in parts (a) and (b) of FIG. 6, the toner images as base images on which the varnish images are formed superposedly were determined in advance, but the present invention is not limited thereto, and the user may be capable of selecting arbitrary toner images. Therefore, a "test chart output processing" in a third embodiment in which the user is capable of selecting the arbitrary toner image will be described using FIGS. 9 and 10. In the following, the third embodiment will be described, but as regards processing which is the same as the processing in the above-described first embodiment, the same reference numerals or symbols are used, and description thereof will be briefly made or omitted.

The "test chart output processing" in the third embodiment shown in FIG. 9 is the same as the "test chart output processing" in the first embodiment shown in FIG. 4 in processes of steps S1 to S6. However, in the case where the recording medium S is accommodated in the cassette 10 (Yes of S2), the main controller 101 causes the operating portion 110 to display a "toner image selecting screen" (see FIG. 10), and makes setting of the toner image in accordance with an operation of the "toner image selecting screen" by the user (S21). Thereafter, the main controller 101 causes the operating portion 110 to display the "test chart selecting screen" (see FIG. 5), and discriminates whether or not the toner image is formed on the test chart in accordance with an operation of the "test chart selecting screen" by the user (S3). Incidentally, on the "test chart selecting screen" (see FIG. 5), the test chart in which the toner image selected from the toner images displayed on the "toner image selecting screen" by the operation of the operating portion 110 by the user is reflected is displayed.

<Toner Image Selecting Screen>

In FIG. 10, the "toner image selecting screen" is shown. As shown in FIG. 10, on the "toner image selecting screen", a list of toner images stored in advance in the ROM 103 or the RAM 104 (see FIG. 3), which are used as the storing portions, is displayed. In FIG. 10, as the display of the list of toner images, images α, β, and γ are displayed. The images α, β, and γ may be, for example, characters, symbols, graphics, photographs, and the like. On a right-hand side of the display of the image list, a check box is provided for each of the toner images. Every time when the check box is clicked by the user, display and non-display of a check mark (sign) indicating that the associated toner image is selected are repeated. The toner image for which the check mark is displayed is set as the toner image formed on the test chart. Incidentally, in this embodiment, the user may be capable of newly and additionally storing an arbitrary toner image as a user library in the RAM 104.

As described above, in the third embodiment, when the test chart is outputted, the user is capable of selecting a desired toner image on which the user intends to superposedly apply the varnish (varnish image) in actuality. Thus, when the user can select the toner image formed on the test chart, the user is capable of evaluating the change in color toner image and the texture due to the varnish by using the toner image which is intended to be obtained finally as a product by the user. By this, the user can reduce a time required for checking an image quality in the case where the varnish images are formed superposedly on the toner images, with the result that productivity of the user can be further improved.

According to the present invention, the test chart on which the plurality of varnish images different in film thickness are formed on the recording medium is outputted, so that the user can grasp the difference in color tint and texture in the case where the varnish images are formed superposedly on the toner image, by actually looking at and comparing the plurality of the varnish images formed superposedly on the toner images.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2021-143045 filed on Sep. 2, 2021, and 2022-111490 filed on Jul. 12, 2022, which are hereby incorporated by reference herein in their entirety.

What is claimed is:

1. An image forming system comprising:

an image forming unit configured to form an image on a recording medium;

a varnish applying unit configured to apply varnish to the image on the recording medium; and a control unit configured to:

control the image forming unit to form a first image and a second image; and control the varnish applying unit to apply varnish to the first image and the second image such that a first varnish application amount applied to the first image by the varnish applying unit is different from a second varnish application amount applied to the second image by the varnish applying unit.

2. The image forming system according to claim 1, wherein the first image and the second image are images each formed in a rectangular shape with the same size.

3. The image forming system according to claim 1, wherein a film thickness of varnish on the first image applied by the varnish applying unit is different from a film thickness of varnish on the second image applied by the varnish applying unit.

4. The image forming system according to claim 1, wherein the first image and the second image are images formed by being arranged with different line widths.

5. The image forming system according to claim 1, further comprising:

a storing portion in which a plurality of images are stored; and a selecting portion configured to select one of the plurality of images stored in the storing portion, wherein the first image and the second image are selected by the selecting portion.

6. The image forming system according to claim 1, wherein the control unit controls the image forming unit to form a third image different in density from the first image, and controls the varnish applying unit to apply varnish to the third image such that a film thickness of varnish on the third image is the same as a film thickness of varnish on the first image.

7. The image forming system according to claim 1, wherein the control unit is configured to control the varnish applying unit to apply varnish to a region on a sheet where no image is formed.

8. The image forming system according to claim 1, further comprising an input portion configured to input film thicknesses of varnish to be applied by the varnish applying unit, wherein the control unit controls film thicknesses of varnish applied to the image based on the film thicknesses inputted by said input portion.

9. The image forming system according to claim 1, wherein the varnish is ultraviolet curable varnish, and wherein said varnish applying unit includes an ejecting portion that ejects the varnish to the image on the recording medium, and an ultraviolet irradiation portion that irradiates ultraviolet rays to the varnish applied to the image on the recording medium.

10. An image forming system comprising:

an image forming unit configured to form an image on a recording medium;

a varnish applying unit configured to apply varnish to form a varnish image on the recording medium; and a control unit configured to control said image forming unit and said varnish applying unit, wherein said control unit is capable of executing an operation in an image forming mode for forming a varnish image by said varnish applying unit on the recording medium on which the image is formed by said image forming unit and an operation in a test chart output mode for outputting a test chart on which a first test varnish image and a second test varnish image different in varnish application amount from the first test varnish image are formed by said varnish applying unit without executing formation of the image on the recording medium by said image forming unit.

* * * * *